United States Patent [19]

Toda et al.

[11] Patent Number: 4,754,245

[45] Date of Patent: Jun. 28, 1988

[54] MULTI-POLE CIRCUIT INTERRUPTER

[75] Inventors: Haruhisa Toda; Junichi Kawakami, both of Fukuyama, Japan

[73] Assignee: Mitsubishi Denki Kabushiki Kaisha, Japan

[21] Appl. No.: 80,107

[22] Filed: Jul. 31, 1987

[30] Foreign Application Priority Data

Aug. 7, 1986 [JP] Japan ..... 61-122792

[51] Int. Cl.[4] ..... H01H 73/12

[52] U.S. Cl. ..... 335/17; 335/9; 337/79

[58] Field of Search ..... 335/8–10, 335/17, 13; 337/45–50, 79

[56] References Cited

U.S. PATENT DOCUMENTS

| | | | |
|---|---|---|---|
| 4,123,734 | 10/1978 | Maier et al. | 335/9 |
| 4,209,761 | 6/1980 | Klein et al. | 335/17 |
| 4,246,557 | 1/1981 | Michetti et al. | 335/17 |

*Primary Examiner*—H. Broome

*Attorney, Agent, or Firm*—Leydig, Voit & Mayer

[57] ABSTRACT

A multi-pole circuit interrupter comprising first and second pole units separated by a partition wall in a housing, each of the pole units having a pair of separable contacts. The contacts of the first and the second pole units are connected by a cross bar for simultaneous movement. An operating mechanism is disposed in the first pole unit for separating the contacts in response to an overcurrent flowing through the interrupter. An alarm switch is disposed in the second pole unit for indicating the tripping of the operating mechanism, and an actuator is disposed between the operating mechanism and the alarm switch for detecting the tripping of the operating mechanism and actuating the alarm switch. The actuator comprises a rotatable shaft supported in the housing and extending through the partition wall including a substantially circular opening having a diameter slightly larger than that of the rotatable shaft, an actuator arm secured to one end of the rotatable shaft for movement caused by the tripping action of the operating mechanism, and an actuator level secured to the other end of the rotatable shaft for engaging and actuating the alarm switch.

1 Claim, 8 Drawing Sheets

MULTI-POLE CIRCUIT INTERRUPTER

BACKGROUND OF THE INVENTION

This invention relates to a multi-pole circuit interrupter having a first pole unit provided with an operating mechanism, a second pole unit provided with no operating mechanism but having an alarm switch, and a partition wall between the first and the second pole units.

A conventional circuit interrupter to which the present invention pertains will be described in conjuction with FIGS. 1 to 4. FIG. 1 is a plan view of a conventional multi-pole circuit interrupter; FIG. 2 is an enlarged cross sectional view taken along line II—II of FIG. 1; FIG. 3 is a partial enlarged sectional view taken alog line III—III of FIG. 1; and FIG. 4 is a partial enlarged view of FIG. 3 illustrating the TRIP position.

In these figures, the circuit interrupter comprises an electrically insulating housing 1 composed of a base 1*a* and a cover 1*b*. The insulating housing 1 is divided by two partition walls 1c into three compartments in order to house therein respective pole units of the multi-pole circuit interrupter. In the illustrated embodiment, the circuit interrupter has a centrally disposed, first pole unit 1A which is provided with an operating mechanism 20, and two second pole units 1B having no operating mechanism and, each provided with an alarm switch 30 (FIG. 3) for detecting the tripping of the circuit interrupter. In each pole unit, a stationary source side conductor 2 is mounted on the base 1*a* and has a stationary contact 3 secured thereon. Mounted in the housing 1 is an automatic trip unit 4 which comprises a trip unit of a thermally responsive electromagnetic type or an electronic type. A stationary load side conductor 5 is electrically connected to the automatic trip unit 4. A movable contact 6 is secured to a movable member 7 which is electrically connected to the automatic trip unit 4 through a flexible conductor 8 and a connector 9. The movable member 7 is supported by a contact arm assembly 10 comprising a first contact arm 10*a* connected to the operating mechanism 20 which will be described in more detail later, and a second contact arm 10*b* on which the movable member 7 is pivotally supported by a first pin 11. The first contact arm 10*a* of each pole unit is also connected to a cross bar 13 for the simultaneous movement of the pole units. The first contact arm 10*a* and the second contact arm 10*b* are independently pivotally supported within the housing by a pivot pin 12. The first contact arm 10*a* has formed therein a first guide hole 14 extending substantially in a direction of movement thereof. The second contact arm 10*b* has formed therein a second elongated guide hole 15 extending in a direction of extension thereof. A sliding pin 16 extends through the first and the second guide holes 14 and 15 to limit the relative pivotal movement between the first and the second contact arms 10*a* and 10*b*. The sliding pin 16 is biased toward a free end portion of the contact arm 10*b* by a tension spring mounted between the sliding pin 16 and the first pin 11 pivotally connecting the movable member 7 to the second contact arm 10*b*. In order to provide a contact biasing force between the movable and the stationary contacts 6 and 3, a contact pressure spring 18 is disposed between the movable member 7 and the second contact arm 10*b*. As is well known, an arc extinguisher 23 is provided in order to extinguish the arc generated between the contacts when they separate. In the first pole provided with an operating mechanism, an operating handle 19 is connected to an operating mechanism 20 comprising a releasable cradle 20*a* having a stop pin 21 and a pair of toggle links 20*b* and 20*c* connected between the cradle 20*a* and the first contact arm 10*a* by pivot pins 22*a* and 22*b*. In order to releasably latch the cradle 20*a* of the operating mechanism 20, a latch 24 is pivotally supported by a pin 25. The latch 24 is engaged by a latch lever 27 which in turn is engaged by a trip rod 26 of the automatic trip unit 4.

In order to transmit the movement of the cradle 20*a* of the operating mechanism 20 (FIGS. 1 and 2) in the first pole unit 1A to the alarm switch 30 (FIGS. 1 and 3) disposed in the second pole unit 1B through the partition wall 1*c*, and opening 28 is formed in the partition wall 1*c* so as to allow an actuator pin 29 (FIG. 1) extending from an actuator 31 which is pivotally mounted by a pin 32 within the second pole 1B to actuate the alarm switch 30. It is seen that the actuator 31 is a substantially U-shaped member having two leg portions 31*a* and 31*b* bent from an elongated plate as seen in FIG. 1, but its leg portions 31*a* and 31*b* are different in length and define an acute angle between them when viewed from the side as seen in FIG. 3. The actuator 31 is biased by a torsion spring (not shown) to rotate clockwise about the pin 32 as shown by an arrow 35 in FIG. 3. The shorter leg 31*a* has the actuator pin 29 which extends through the opening 28 and is engageable with the latch end of the cradle 20*a*, and the longer leg 31*b* has an end engageable with the alarm switch 30 for the actuation thereof.

When the first pole unit 1A of the circuit interrupter is in the ON position shown in FIGS. 1 and 2, an electric current flows from the source side stationary conductor 2 to the load side stationary conductor 5 through the stationary contact 3, the movable contact 6, the movable member 7, the flexible conductor 8, the connector 9 and the automatic trip unit 4 in the named order. When the second pole unit 1B of the circuit interrupter is in the ON position shown in FIGS. 1 and 3, an electric current flows from the source side stationary conductor 2 to the load side stationary conductor 5 through the stationary contact 3, the movable contact 6, the movable member 7, the flexible conductor 8 and the connector 9 in the named order.

When the operating handle 19 is moved into the OFF position as shown by an arrow 33 of FIG. 2, the contact arm assembly 10 is lifted by the operating mechanism 20 so that the movable contact 6 together with the movable member 7 is moved away from the stationary contact 3 to separate the contacts 3 and 6. At this time, since the sliding pin 16 is positioned in the recessed portion 14*a* of the guide hole 14 due to the biasing function of the tension spring 17, the second contact arm 10*b* is rotated about the pivot pin 12 into the opening direction by the operating mechanism 20 together with the first contact arm 10*a* until it abuts against the stop pin 21. Since the first contact arms 10*a* of the pole units are rigidly connected to each other by a cross bar 13, three pole units open simultaneously.

In the ON position shown in FIGS. 1 and 2, when an overload current flows through the circuit interrupter, the automatic trip unit 4 is actuated to release the cradle 20*a* of the operating mechanism 20 to allow it to rotate in a direction of arrow 25 of FIG. 2. Then, the toggle links 20*b* and 20*c* of the operating mechanism 20 rotate the contact arm assembly 10 in the clockwise direction in the figure to separate the movable contact 6 from the stationary contact 3, thereby interrupting the overload current. This is the socalled tripped position. During this operation, since the sliding pin 16 is positioned within the recessed portion 14*a* of the guidehole 14 due to the tension spring 17, the second contact arm 10*b* is rotated clockwise about the pivot shaft 12 by the operating mechanism 20 together with the first contact arm 10*a* until it abuts against the stopper pin 21. This movement of the first contact arm 10*a* of the first pole unit 1A is transmitted to the first contact arm 10*a* in the second pole unit 1B through the cross bar 13, so that the contact arm assembly 10 of the second pole unit 1B is also moved into an open position as shown in FIG. 4.

As soon as the cradle 20*a* is released and rotated during contact opening, the actuator pin 29 is released from the engagement by the cradle 29 so as to allow it to move upwardly, and the actuator 31 shown in FIG. 3 rotates about the pin 32 as shown by the arrow 35. Then, the longer leg 31*b* of the actuator 31 moves away from the alarm switch 30 as shown in FIG. 4, whereby the alarm switch 30 detects the fact that the operating mechanism of the circuit interrupter is in a tripped position and generates an alarm indicative of the tripping of the circuit interrupter.

When a large current such as a short-circuit current flows through the circuit interrupter in the ON position shown in FIGS. 1 to 3, an electromagnetic repulsive force generated between the stationary conductor 2 and the movable member 7 causes the movable member 7 to immediately separate from the stationary conductor 2. At this time, since the operating mechanism 20 does not allow the first contact arm 10*a* to be actuated because it is not actuated, the second contact arm 10*b* rotates clockwise about the shaft 12 by moving the sliding pin 16 against the spring force of the tension spring 17 from the recessed portion 14*a* along the guide hole 14 until it abuts against the end portion 14*b* of the guide hole 14. The electromagnetic repulsive force generates very quickly upon the occurence of a short-circuit current and therefore contact separation is achieved before the operating mechanism 4 is actuated, providing a high current limiting capability.

With the conventional multi-pole circuit interrupter as above described, the movement of the cradle 19 is transmitted to the alarm switch 30 by the upward movement of the actuator pin 29 extending through the partition wall 1*c*. Therefore, the opening 28 for allowing the movement of the actuator pin 29 must be an elongted hole as shown in FIGS. 2 to 4. Thus, the opening 28 has a relatively large area, communicating the compartments through the relatively large opening, so that the electrical insulation between the compartments provided by the partition wall 1*c* is degraded.

SUMMARY OF THE INVENTION

Accordingly, an object of the present invention is to provide a multi-pole circuit interrupter in which the electrical insulation between the pole unit compartments is improved.

Another object of the present invention is to provide a multi-pole circuit interrupter of the type where an alarm switch is actuated by an actuator pin extending through a partition wall in which the electrical insulation between the pole unit compartments is improved and the opening in the partition wall is small.

With the above objects in view, the multi-pole circuit interrupter of the present invention comprises first and second pole units separated by a partition wall in a housing, each of the pole units having a pair of separable contacts. The contacts of the first and the second pole units are connected by a cross bar for simultaneous movement. An operating mechanism is disposed in the first pole unit for separating the contacts in response to an overcurrent flowing through the interrupter. An alarm switch is disposed in the second pole unit for indicating the tripping of the operating mechanism, and an actuator is disposed between the operating mechanism and the alarm switch for detecting the tripping of the operating mechanism and actuating the alarm switch. The actuator comprises a rotatable shaft supported in the housing and extending through the partition wall including a substantially circular opening having a diameter slightly larger than that of the rotatable shaft, an actuator arm secured to one end of the rotatable shaft for movement caused by the tripping action of the operating mechanism, and an actuator lever secured to the other end of the rotatable shaft for engaging and actuating the alarm switch.

BRIEF DESCRIPTION OF THE DRAWINGS

The present invention will become more readily apparent from the following detailed description of the preferred embodiment taken in conjunction with the accompanying drawings, in which.

DESCRIPTION OF THE PREFERRED EMBODIMENT

Figure 1:
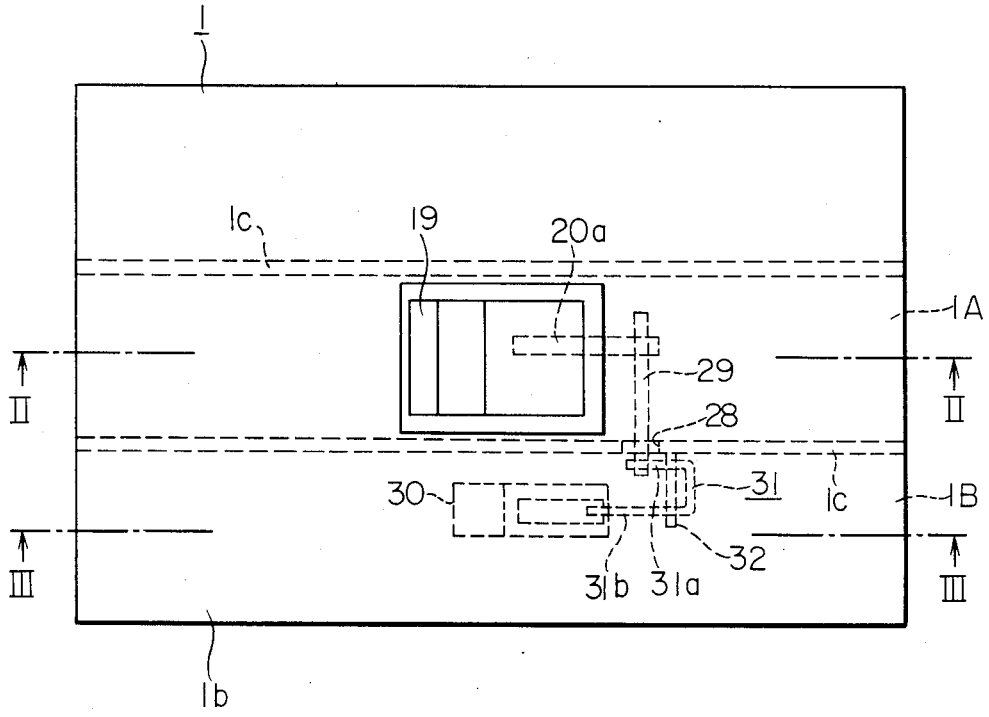
FIG. 1 PRIOR ART
FIG. 1 is a plan view of a conventional multi-pole circuit interrupter.
Figure 2:
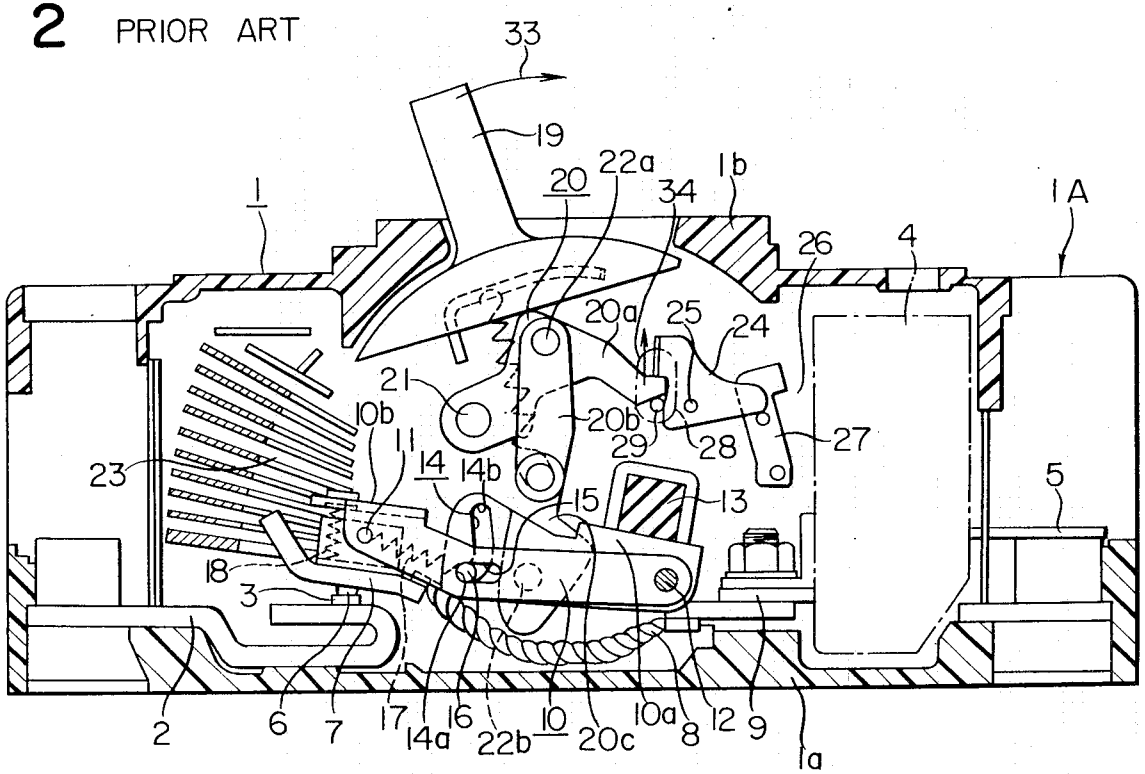
FIG. 2 PRIOR ART
FIG. 2 is a cross-sectional view taken along line II—II of FIG. 1.
Figure 3:
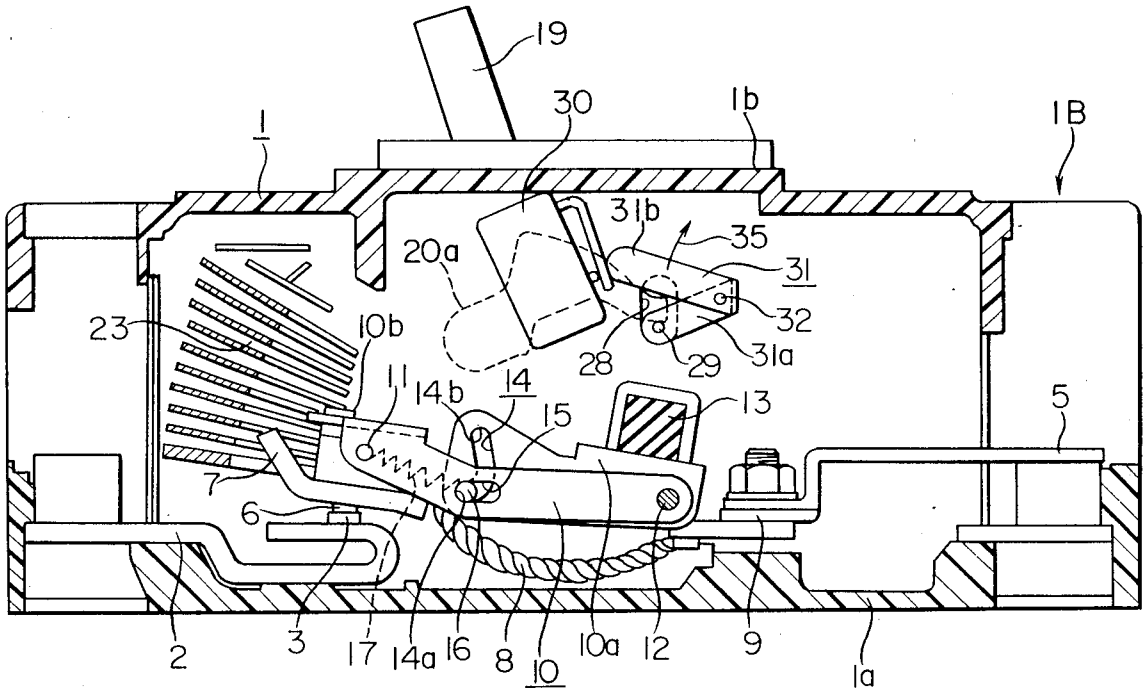
FIG. 3 PRIOR ART
FIG. 3 is a partial enlarged sectional view taken along line III—III of FIG. 1.
Figure 4:
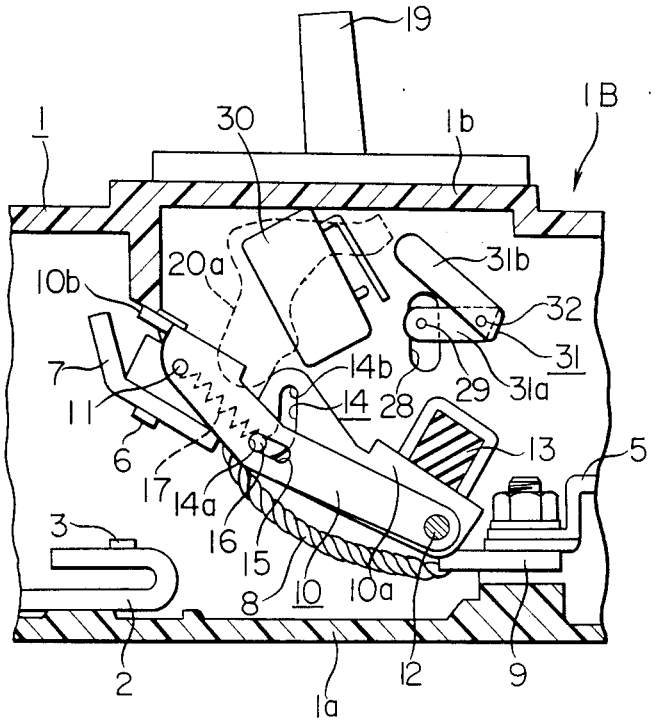
FIG. 4 PRIOR ART
FIG. 4 is a partial enlarged view of FIG. 3 illustrating the TRIP position.
Figure 5:
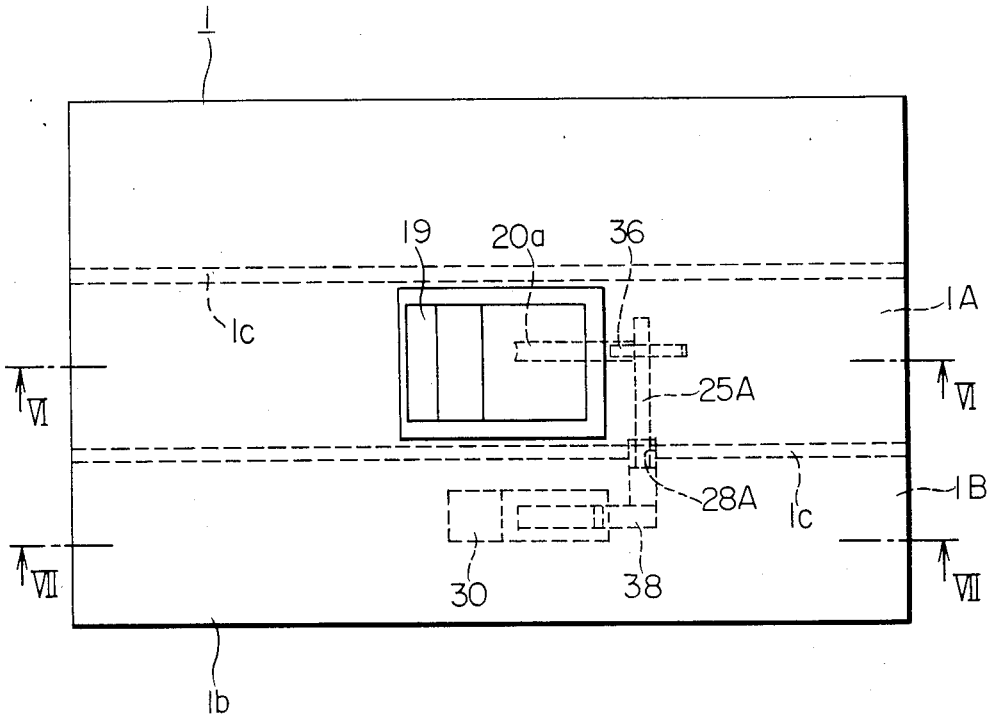
FIG. 5 is a plan view of a multi-pole circuit interrupter of the present invention.
Figure 6:
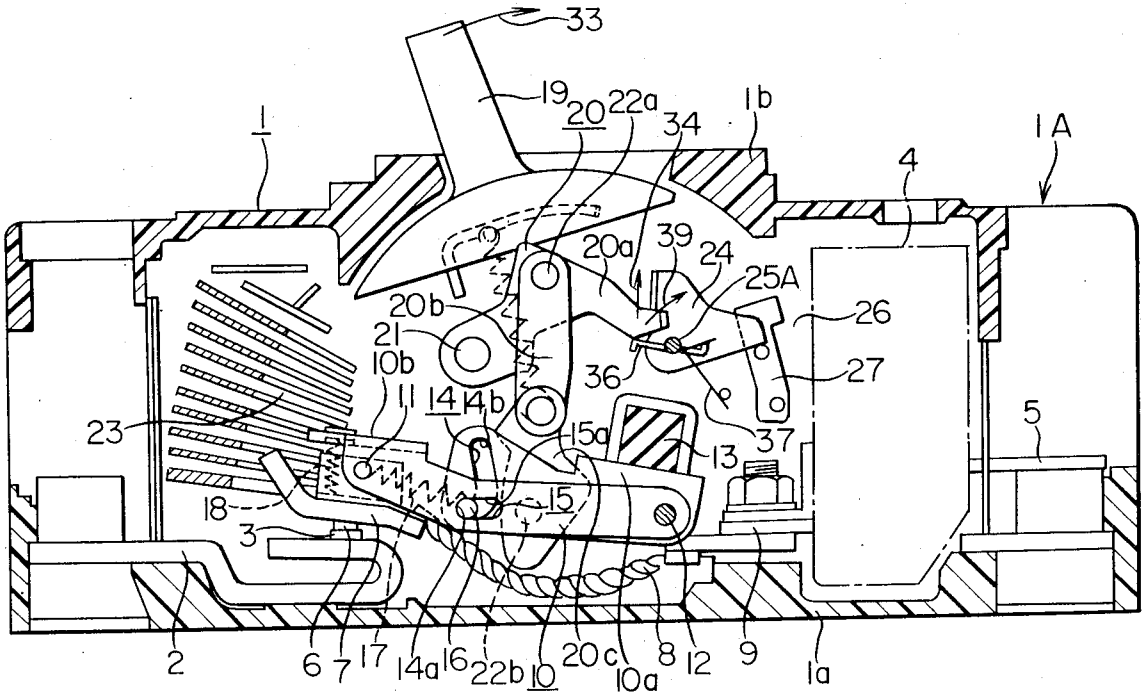
FIG. 6 is a cross-sectional view taken along line VI—VI of FIG. 5.
Figure 7:
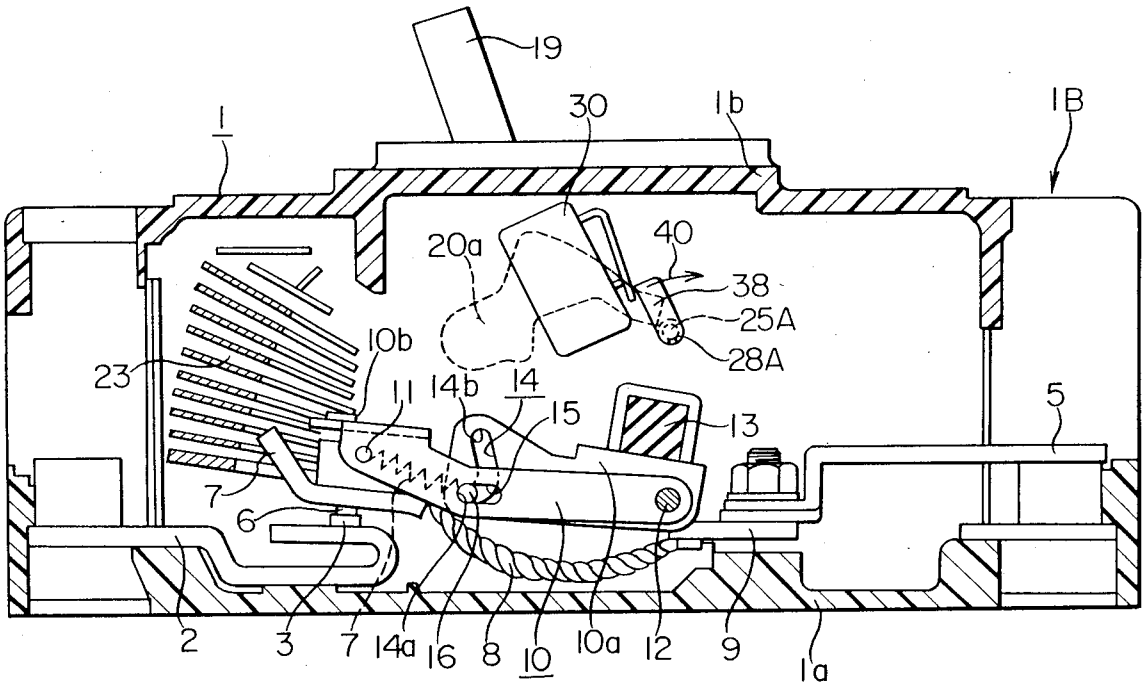
FIG. 7 is a partial enlarged sectional view taken along line VII—VII of FIG. 5.
Figure 8:
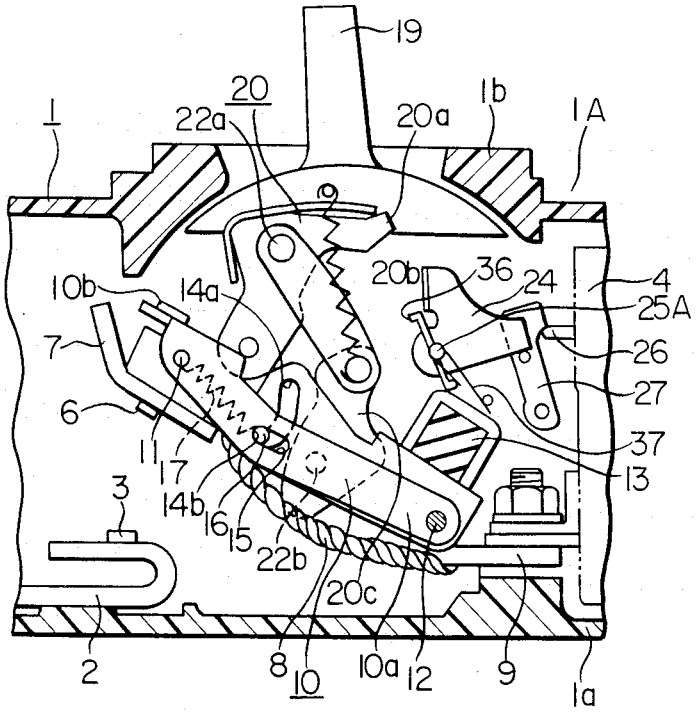
FIG. 8 is a partial view of FIG. 6 but illustrating the tripped position.
Figure 9:
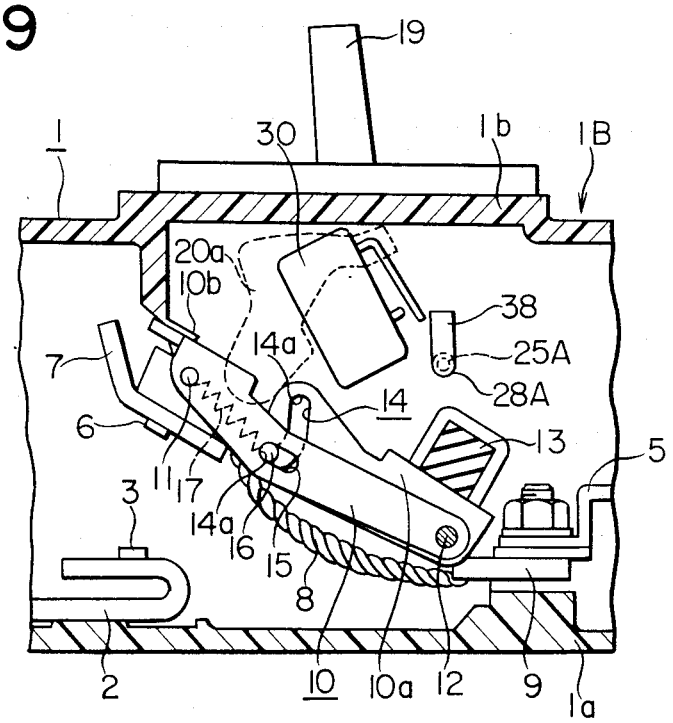
FIG. 9 is a partial view of FIG. 7 but illustrating the tripped position.

A multi-pole circuit interrupter of one embodiment of the present invention will now be described in conjunction with FIGS. 5 to 9. FIG. 5 is a plan view of a multi-pole circuit interrupter of the present invention, FIG. 6 is a cross-sectional view taken along line VI—VI of FIG. 5, FIG. 7 is a partial enlarged sectional view taken along line VII—VII of FIG. 5, FIG. 8 is a partial view of FIG. 6 but illustrating the tripped position, and FIG. 9 is a partial view of FIG. 7 but illustrating the tripped position. In the figures, the same reference numerals designate identical or corresponding components.

In these figures, the operating mechanism 20 of the multi-pole circuit interrupter of the present invention is identical to that of the conventional circuit interrupter previously described in terms of FIGS. 1 to 5. However, the arrangement for transmitting the movement of the operating mechanism to the alarm switch disposed in the adjacent second pole unit compartment is different. In FIG. 6, it is seen that the latch 24 for releasably latching the cradle 20*a* is supported by a shaft 25A rotatably supported by an unillustrated frame disposed in the housing. As best seen from FIG. 5, the shaft 25A extends through a circular opening 28A formed in the partition wall 1*c* into the next compartment in which the second pole unit 1B and the alarm switch 30 are housed. The actuator shaft 25A has secured thereon an arm 36, and the arm 36 together with the shaft 25A is biased to rotate in the clockwise direction by a torsion spring 37 mounted between the arm 36 and a pin disposed on the support frame (not shown). In the ON position shown in FIG. 6, the arm 36 is positioned under the cradle 20*a* which is latched in the illustrated position by the latch member 24. The end of the shaft 25A in the second pole unit 1B has secured thereon an actuator 38 for actuating the alarm switch 30. In the ON position shown in FIG. 7, the actuator 38 is in the position actuating the alarm switch 30.

When an overcurrent flows through the circuit interrupter, the automatic trip unit 4 releases the cradle 20*a* by the latch mechanism 24 and 27 to actuate the operating mechanism to trip open the contacts 3 and 6 as shown in FIG. 8. As soon as the cradle 20*a* is released, the latching end of the cradle 20*a* moves upwardly as shown by the arrow 34, and the arm 36 on the shaft 25A rotates clockwise as shown by the arrow 39 because of the biasing force of the torsion spring 37. This clockwise rotation of the arm 36 is transmitted through the shaft 25A to the actuator 38 disposed in the second pole unit 1B to cause it to rotate in the direction of an arrow 40 in FIG. 7 into the position shown in FIG. 9.

As has been described, the tripping motion of the cradle 20*a* of the operating mechanism 20 in the first pole unit 1A is transmitted to the alarm switch 30 disposed in the second pole unit 1B through the rotational movement of the cylindrical rotary shaft 25A. Therefore, only a small clearance is needed around the rotary shaft 25A and the opening 28A for allowing the passage and the movement of the shaft 25A through the partition wall 1*c* can be a circular opening which is very small as compared to the elongated opening 28 used in the conventional circuit interrupter as illustrated in FIGS. 1 to 5. Since the opening 28A is very small, degradation of the electrical insulation between the pole units 1A and 1B is minimized.

What is claimed is:

1. A multi-pole circuit interrupter comprising:

an electrically insulating housing having a partition wall defining a plurality of compartments;

a first pole unit disposed in one of said compartments and having a pair of separable contacts and an operating mechanism for separating said contacts in response to an overcurrent flowing through the circuit interrupter;

a second pole unit disposed in another of said compartments and having a pair of separable contacts;

a cross bar for connecting said contacts of said first and said second pole units for simultaneous movement thereof;

an alarm switch disposed in said second pole unit for indicating tripping of said operating mechanism; and an actuator disposed between said operating mechanism and said alarm switch for detecting the tripping of said operating mechanism to actuate said alarm switch;

said actuator comprising a rotatable shaft supported in said housing and extending through said partition wall, said partition wall including a substantially circular opening having a diameter slightly larger than that of said rotatable shaft, an actuator arm secured to one end of said rotatable shaft for movement caused by the tripping action of said operating mechanism, and an actuator lever secured to the other end of said rotatable shaft for engaging and actuating said alarm switch.

* * * * *